United States Patent [19]

Gisbert

[11] 3,952,351

[45] Apr. 27, 1976

[54] SWIMMING AID DEVICE

[76] Inventor: Miguel Gisbert, 4355 E. 8th Lane, Hialeah, Fla. 33013

[22] Filed: Mar. 24, 1975

[21] Appl. No.: 561,211

[52] U.S. Cl. ..... 9/304
[51] Int. Cl.[2] ..... A63B 31/14
[58] Field of Search ..... 9/302, 303, 304

[56] References Cited

UNITED STATES PATENTS

| | | | |
|---|---|---|---|
| 1,113,820 | 10/1914 | Osterberg | 9/304 |
| 1,341,290 | 5/1920 | Webster | 9/304 |
| 1,636,316 | 7/1927 | Noesske | 9/304 |
| 1,841,904 | 1/1932 | McGowan | 9/304 |

*Primary Examiner*—Trygve M. Blix

*Assistant Examiner*—Gregory W. O'Connor

[57] ABSTRACT

The device of the present invention comprises a footwear member such as a sandal, attached to a swimmer's foot by strap or thong means, and a forwardly projecting fin shaped frame member, fixed to the sandal and including a plurality of longitudinally extending vanes, pivotally attached between the opposed end wall portions of the frame. When the swimmer moves the device inwardly toward his or her body, the vanes open in response to the reactive forces of the water, permitting the water to pass between the vanes; when the device is moved away from the body, the reactive forces of the water close the vanes relative to each other, creating a condition whereby the swimmer is propelled forwardly through the water.

9 Claims, 2 Drawing Figures

SWIMMING AID DEVICE

OBJECTS AND ADVANTAGES OF THE PRESENT INVENTION

One of the principal objects of the present invention is to provide a swimming aid device in the general form of a fin, projecting forwardly from an article of footwear such as a sandal, including a plurality of vanes which react to the various water pressures or forces to propel a swimmer through the water at a substantially greater rate of speed than can be accomplished without the device.

Another principal object of this invention is to provide a device of the above described nature in which the fin is comprised of a frame including front, back and opposed side portions with rearwardly projecting arms to a sole plate which is fixed as by rivets to the sole portion of the article of footwear; the vanes react to the movements of the swimmer in a manner so as to propel him or her through the water.

A further object of the instant invention is to provide the pivotal vanes with stop means which maintain said vanes in a proper open condition relative to each other while the swimmer is in the act of retracting the foot engaged therewith, the power stroke of the foot automatically closes the vanes relative to each other, causing the reacting forces of the water to provide forward propulsion through the water.

Another object of this invention is to provide the fin portion of the device in a position, spaced somewhat above the article of footwear, to permit the wearer to walk while out of the water.

DETAILED DESCRIPTION OF THE DRAWINGS

Figure 1:
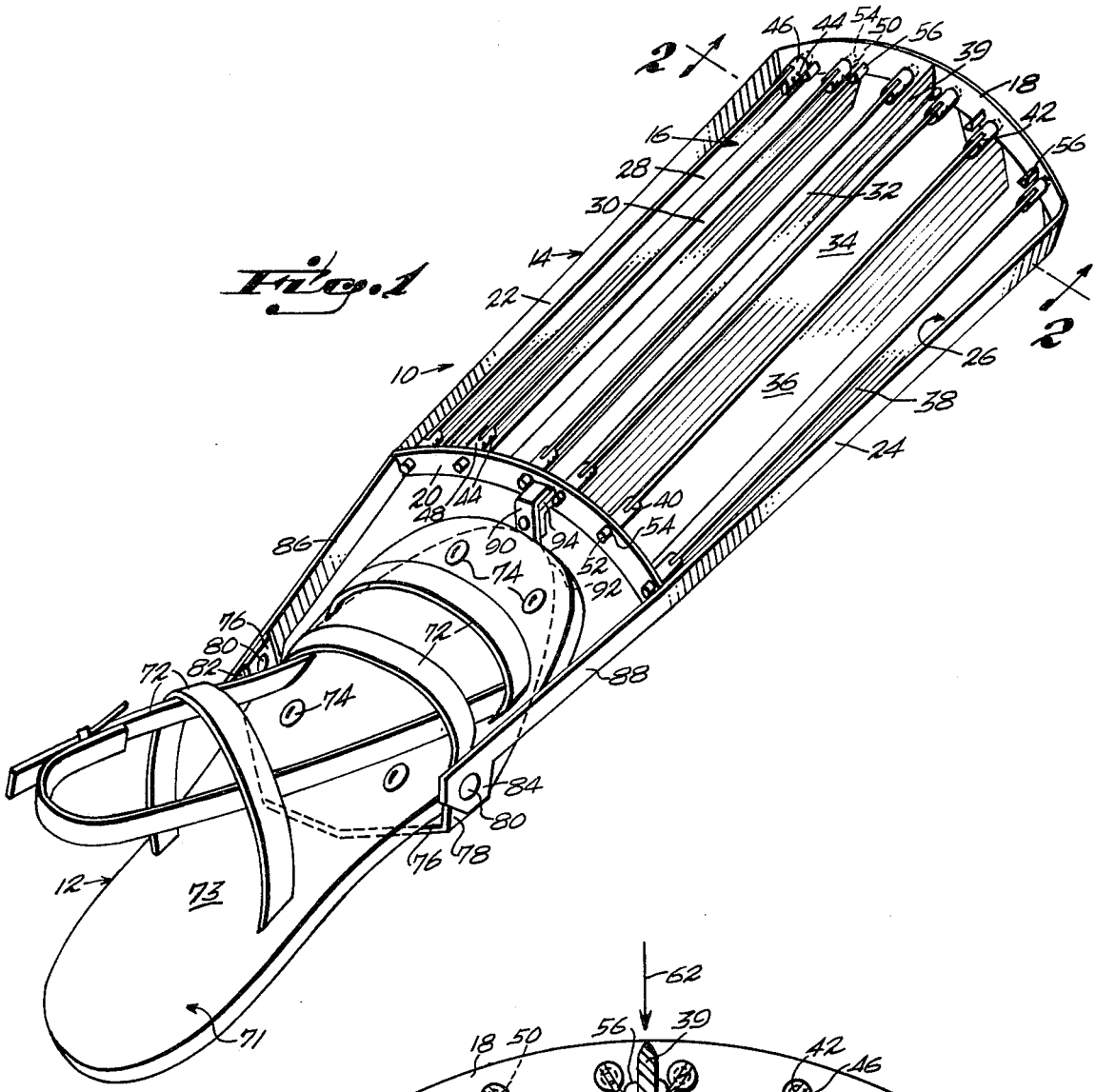
FIG. 1 is a perspective view of the swimming aid device of the present invention.

With reference to the drawings in which like reference characters designate like or corresponding parts throughout the two views and with particular reference to FIG. 1, the numeral 10 generally designates the swimming aid device of the present invention. The device includes a footwear member 12 fixed rearwardly of a frame 14 pivotally carrying a plurality of vanes 16.

Front and back arcuate end walls 18 and 20 and a pair of spaced apart side walls 22 and 24 of the frame 14 define an elongated opening 26 containing the vanes 16. In the form of the invention illustrated in the drawings, six vanes 28 through 38 are provided, three on each side of a central brace or rigidifying member 39, extending along the main axis of the opening 26, between the arcuate end walls 18 and 20. The opposed upper ends of each vane 16 are fixed in respective slots 40 and 42, as by pins or rivets 44, in front and back studs 46 and 48 which include reduced diameter end pin portions 50 and 52, rotatably journaled in holes 54 in the front and back walls 18 and 20.

Figure 2:
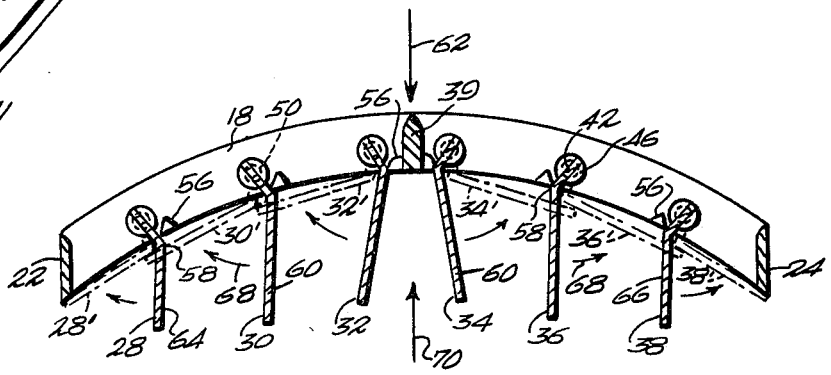
FIG. 2 is a cross sectional view taken along the line 2—2 of FIG. 1 and looking in the direction of the arrows.

As illustrated, the vanes 16 normally depend from the studs 46 and 48 by the forces of gravity. Stop means in the form of fixed pins 56 extend inwardly from the front wall 18 of frame 14 to limit the inward, downward rotation of the two sets of three vanes toward the central brace 39, in opposed first directions of rotation. As best illustrated in FIG. 2, each vane 28 through 38 is longitudinally angulated as at 58 and the main widths 60 thereof are slightly angulated outwardly toward the respective side walls 22 and 24 in their normally downwardly depending positions. Consequently, when the frame 14 is moved downwardly as indicated by the arrow 62, FIG. 2, upwardly directed forces, created by the reaction forces in water, against the vane faces such as 64 and 66 will immediately rotate the two sets of vanes in second directions indicated by arrows 68, to the closed overlapping positions of the broken lines 28' through 38'. When the direction of movement of frame 16 is reversed as indicated by arrow 70, reactive forces of the water above the device will move the vanes 28 through 38 back to the full line illustration of FIG. 2, permitting a free flow of water between the vanes.

The footwear member 12 may be in the form of a sandal 71, FIG. 1, having a plurality of thongs 72 to engage over the foot and around the ankle of a person to maintain the device in a proper position. The sandal 71 includes a sole 73 fixed as by rivets 74 atop a sole plate 76 carried by a pair of upstanding side ears 76–78. Attachment means such as rivets 80 fix the ears 76–78 to respective downwardly extending lugs 82–84 from the rear ends of respective side arm extensions 86–88 from the frame side walls 22 and 24. A third attachment is provided between the sole plate 76 in the form of bracket means 90, from the sole plate toe portion 92, in engagement with a lug 94, fixed to the back end wall 20 of frame 14.

In use, one of the swimming aid devices of the present invention is positioned on each foot of a swimmer. A generally outward or downward power stroke of each leg of the swimmer will cause the vanes 28 through 38 to move to their closed, overlapped condition, above described, causing the reactive forces of the water to propel the user forwardly through the water. Inward strokes of the swimmer's legs causes the vanes to open, permitting the water to freely pass between the vanes of the devices until they are respectively positioned for the next power strokes whereupon the vanes will again close, causing a further propulsion of the swimmer through the water.

What is claimed is:

1. A swimming aid device comprising:

A. an article of footwear including,
   1. means to attach said article to the foot of a wearer;

B. a main, elongated frame assembly, extending forwardly of said article of footwear, including,
   1. front and back walls, and
   2. spaced apart side walls defining an elongated central opening;

C. a plurality of vanes pivotally connected in said central opening at their respective upper edge end portions between said front and back walls and being pivotal between first, generally parallel open positions relative to said central opening, and second, overlapping positions in a substantially closing relation to said central opening;

D. means to connect said main elongated frame assembly to said article of footwear;

E. said means to connect comprises a pair of rearwardly extending arms from the respective side walls of said main frame and a sole plate connected between said rearwardly extending arms and a sole portion of said article of footwear.

2. The swimming aid device as defined in claim 1 including stop means positioned and fixed relative to said main, elongated frame to position said vanes in said first, open positions.

3. The swimming aid device as defined in claim 2 wherein said stop means are in the form of an inwardly extending projection from said front wall for each of said vanes.

4. The swimming aid device as defined in claim 1 wherein said front and back walls are arcuately curved downwardly.

5. The swimming aid device as defined in claim 1 including a central brace member extending between, and fixed to said front and back end walls along the main axis of said central opening.

6. The swimming aid device as defined in claim 5 wherein said plurality of vanes comprises six vanes in two sets of three, one set being positioned on each side of said central brace member, said two sets of three vanes being pivotally operable in opposed directions between said first, open positions, and second, overlapping closed positions.

7. The swimming aid device as defined in claim 1 including a downwardly extending lug from each one of said arms, fixed as by rivet means to an upwardly extending lug from said sole plate.

8. The swimming aid device as defined in claim 1 wherein said article of footwear comprises a sandal including a sole portion and thongs to engage around the foot and ankle area of a swimmer.

9. The swimming aid device as defined in claim 7 including bracket means connecting a toe portion of said sole plate to said back wall.

* * * * *